United States Patent [19]

Fraser et al.

[11] 4,432,705

[45] Feb. 21, 1984

[54] REFRIGERATION COMPRESSOR CAPACITY CONTROL MEANS AND METHOD

[75] Inventors: Bruce A. Fraser, Chittenango; Curtis Holt, Jr., East Syracuse, both of N.Y.

[73] Assignee: Carrier Corporation, Syracuse, N.Y.

[21] Appl. No.: 182,167

[22] Filed: Aug. 28, 1980

Related U.S. Application Data

[63] Continuation of Ser. No. 944,237, Sep. 20, 1978, abandoned.

[51] Int. Cl.[3] ..... F04B 49/02

[52] U.S. Cl. ..... 417/295

[58] Field of Search ..... 417/295, 298; 62/228 C, 62/228 D

[56] References Cited

U.S. PATENT DOCUMENTS

| | | | |
|---|---|---|---|
| 2,350,537 | 6/1944 | Scott | 417/295 |
| 2,691,388 | 10/1954 | Livers | 417/295 X |
| 3,041,847 | 7/1962 | Harter et al. | 62/228 C |
| 3,264,842 | 8/1966 | Dobbie | 417/295 X |
| 3,578,883 | 5/1971 | Cheney | 417/295 X |

*Primary Examiner*—Richard E. Gluck

*Attorney, Agent, or Firm*—Donald F. Daley; David J. Zobkiw

[57] ABSTRACT

A capacity control for a multi-cylinder refrigeration compressor includes a modulating valve disposed between a suction manifold and less than all of the cylinders of the refrigeration compressor. The modulating valve regulates the flow of refrigerant gas from the manifold to the cylinders in communication therewith, with the valve functioning to increase the flow of refrigerant gas to the cylinders as the load on the refrigeration unit increases and to decrease the flow of refrigerant as the load on the refrigeration unit decreases.

5 Claims, 3 Drawing Figures

REFRIGERATION COMPRESSOR CAPACITY CONTROL MEANS AND METHOD

This application is a continuation of Ser. No. 944,237, filed Sept. 20, 1978, now abandoned.

BACKGROUND OF THE INVENTION

This invention relates to capacity control of a refrigeration compressor, and in particular, to a capacity control device which decreases the power input requirements of the compressor motor as the load on the refrigeration unit decreases.

Mechanical refrigeration units, such as those employed in air conditioning systems, normally operate under varying load conditions. Typically, the units are designed to deliver conditioned air at a temperature of 72° F. at high ambients, such as 95° F. (hereinafter maximum load.) When the refrigeration unit is operating at less than maximum load conditions, it is desirable to reduce the refrigeration producing capacity thereof.

Numerous schemes have been proposed to reduce the capacity of a refrigeration unit operating at less than maximum load conditions to not only reduce the refrigeration producing capabilities of the unit to prevent undesired overcooling of a space being served by the unit, but also to reduce the input power required to operate the refrigeration unit. In effect, a refrigeration unit operating under conditions that require less than 100% capacity should ideally be designed to operate at reduced input power requirements to effectively conserve energy.

An example of a prior art capacity reduction device is disclosed in U.S. Pat. No. 3,578,883. This patent discloses the use of a valve to unload one or more cylinders of a refrigeration compressor when reduced capacity is desired.

The valve employed in the cited U.S. Pat. No. 3,578,883 patent is disposed between the suction manifold of the refrigeration compressor and one or more of the refrigerant compressor cylinders. When it is desired to unload the cylinders, to reduce the capacity of the compressor, the valve disposed within the manifold is placed in a position to terminate flow of the refrigerant gas from the manifold to the cylinders. While this method of achieving capacity control has proven somewhat effective, it has been found that further reductions in power input requirements at reduced loads may be obtained by modulating the valve as compared to operating the valve so it either is in an "open" position whereby full flow of refrigerant passes from the manifold to the cylinder or in a "closed" position whereby total flow of refrigerant gas is terminated.

Test results have indicated that a reduction of the input power requirements of approximately 10% may be achieved by modulating the valve to vary the flow of refrigerant to at least one of the cylinders of the compressor as compared to opening or closing a valve in the manner disclosed in the cited patent, particularly when it is desirable to reduce the capacity of the unit to 20%–40% of its maximum load rating.

SUMMARY OF THE INVENTION

Accordingly, it is an object of this invention to improve capacity reducing apparatus employed with refrigeration compressors.

It is a further object of this invention to decrease the power input requirements of a refrigeration compressor as the capacity thereof is also reduced.

It is a further object of this invention to modulate the flow of refrigerant gas to the cylinders of a refrigerant gas compressor to achieve capacity control thereof.

These and other objects of the present invention are attained in capacity control apparatus of a multi-cylinder refrigerant compressor employed in a mechanical refrigeration unit including a modulating valve disposed between a suction manifold, and less than all of the compressor's cylinders. The apparatus further includes control means for regulating the operation of the modulating valve directly in accordance with changes in the load on the refrigeration unit such that the valve increases the flow of refrigerant to the cylinders as the load increases and decreases the flow of refrigerant as the load decreases.

DESCRIPTION OF THE PREFERRED EMBODIMENT

Figure 1:
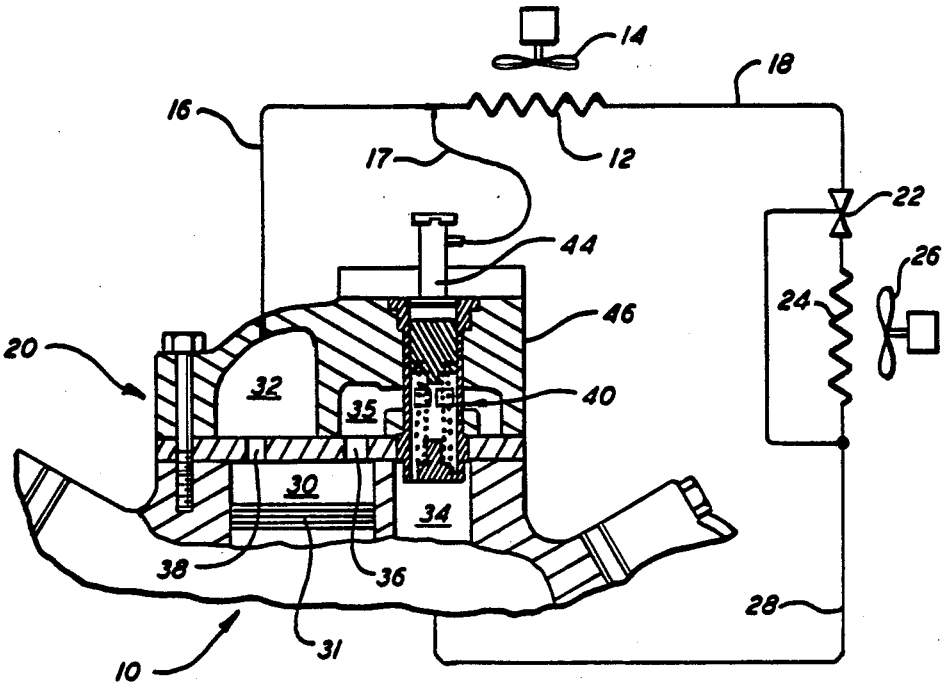
FIG. 1 of the drawing schematically illustrates a mechanical refrigeration unit including a refrigeration compressor embodying the present invention.

Referring to the drawing, there is disclosed a preferred embodiment of the present invention. In referring to the various figures of the drawing, like numerals shall refer to like parts.

Referring particularly to FIG. 1, there is disclosed a mechanical refrigeration unit 10 including an outdoor heat exchange coil 12, an indoor heat exchange coil 24, a compressor 20 and an expansion device 22. High pressure refrigerant gas compressed by operation of compressor 20 is discharged through conduit 16 and delivered to outdoor heat exchange coil 12 whereat fan 14 routes ambient air over the surface of the coil to condense the vaporous refrigerant flowing therethrough. The condensed refrigerant is delivered via conduit 18 through expansion device 22 to indoor heat exchange coil 24. The indoor coil has air or water to be cooled routed thereover by operation of fan 26. The air routed over the surface of coil 24 rejects heat to the refrigerant flowing therethrough causing the refrigerant to be vaporized. The vaporous refrigerant is returned to the suction side of the compressor via conduit 28. The aforedescribed mechanical refrigeration unit is conventional and is typical of units employed in mechanical air conditioning systems.

In many applications, multi-cylinder compressors are utilized. Generally multi-cylinder compressors are designed to function with all cylinders fully loaded when ambient temperatures are relatively high, as for example at 95° F. At such high ambient temperatures, the cooling load on the refrigeration unit is also large. At less than maximum load conditions, it is desirable to reduce the refrigeration capacity of the refrigeration unit to prevent overcooling of the space served by the unit and to reduce the power input requirements thereof. Many known compressor capacity control devices have been used on multi-cylinder compressors in attempts to achieve the aforegoing capacity reduction at reduced cooling loads. One such capacity control device includes the utilization of a valve disposed between the suction manifold and some of the cylinders of the compressor to terminate flow of refrigerant from the manifold to the cylinders when reduced capacity of the compressor is desired. While this form of capacity control has been found to be relatively efficient, it has been additionally determined that improvements in such arrangement can effectively reduce the power input requirements by a considerable amount.

Figure 2:
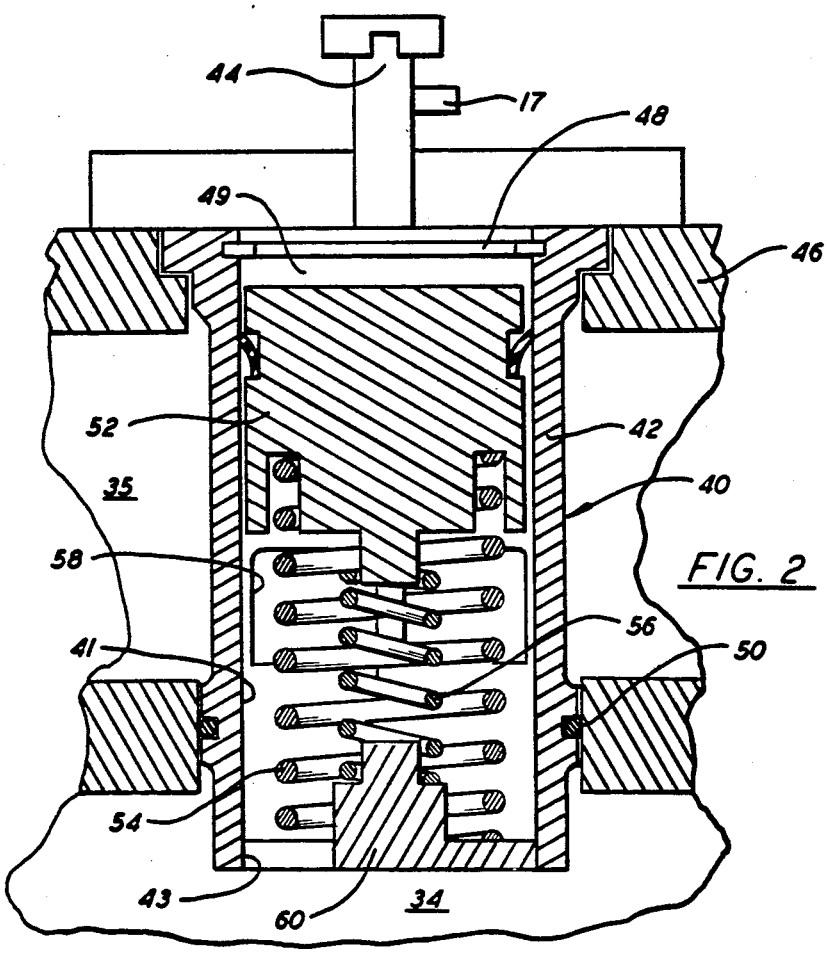
FIG. 2 is an enlarged sectional view showing the details of the present invention.

Referring particularly to FIG. 2, there are disclosed the details of the present capacity control arrangement employed to reduce the cooling capabilities of the refrigeration unit at reduced cooling loads and simultaneously to decrease the input power requirements of the compressor to conserve energy.

The capacity control device of the present invention includes a housing 42 mounted within the cylinder head 46 of the compressor. The housing has an inlet 43 in communication with suction manifold 34 and includes an outlet preferably defined by one or more ports 58. Refrigerant gas flowing through ports 58 is delivered into a suction header 35 for an individual cylinder. Each cylinder or bank of cylinders will generally be associated with a separate suction header. The suction gas passing from header 35 flows through suction ports 36 into compressor cylinder 30. The refrigerant gas in cylinder 30 is compressed by reciprocal movement of piston 31 therein and is discharged therefrom through ports 38 into discharge chamber 32. The flow of refrigerant gas through ports 36 and 38 are controlled by suitable valves, as is well-known by those skilled in the art.

A piston type device 52 is movably disposed within bore 41 defined by housing 42. A retainer ring 48 maintains piston 52 within the bore. Springs 54 and 56, mounted on retainer 60, provide a force to move piston 52 upwardly within bore 41. A relatively constant magnitude force is developed in chamber 49 located above the top surface of piston 52 in opposition to the force acting on the bottom surface thereof generated by springs 54 and 56. The constant magnitude force may be generated by the pressure of the discharge gas passing through conduits 16 and 17. A constant pressure valve 44 is utilized to control the pressure of the gas flowing through conduit 17 to maintain the pressure in chamber 49 at a predetermined magnitude. An O-ring 50 is provided to prevent leakage between the opposed surfaces of housing 42 and the cylinder block in which the valve 40 is mounted. A force developed by the suction pressure of the gas in manifold 34 operates in combination with the force developed by springs 54 and 56 on the bottom surface of piston 52 to move the piston upwardly within bore 41.

Discussing valve 44 in greater detail, this valve includes shell 70, base 72, spring 74, diaphragm 76, pin 80, and ball 82. Diaphragm 76 is secured within shell 70, dividing the shell into upper chamber 84, in which spring 74 is located, and lower chamber 86. The lower portion of shell 70 defines inlet opening 90 and outlet opening 92, both of which are in communication with shell chamber 86. Base 72 defines inlet passage 94 in communication with inlet opening 90, and outlet passage 96 in communication with outlet opening 92. Pin 80 extends through inlet opening 90, and ball 82 is secured to the lower end of pin 80, adjacent the inlet opening.

Figure 3:
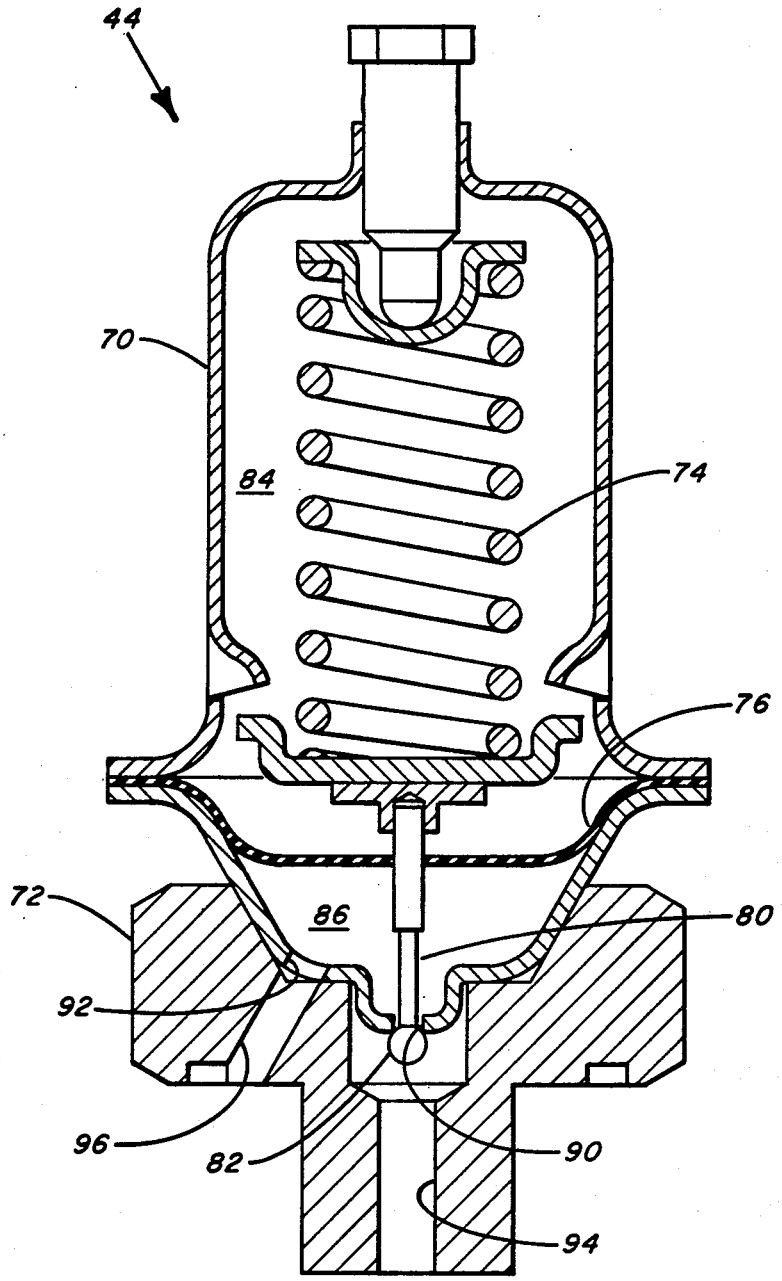
FIG. 3 is a cross-sectional view of a constant pressure valve which may be employed in the practice of the present invention.

In assembly, with reference to FIGS. 1 and 3, high pressure line 17 shown in FIG. 1, is connected to inlet passage 94, and chamber 49 of piston housing 42 is connected to outlet passage 96. Spring 74 exerts a downward force on diaphragm 76; and this force is countered by vapor pressure within chamber 86, which exerts an upward force on diaphragm 76. At equilibrium conditions, ball 82 is slightly spaced from inlet opening 90, the vapor mass flow rate into chamber 86 equals the vapor mass flow rate out of this chamber, the pressure in chamber 86 is constant, the upward force on diaphragm 76 is equal to the downward force thereon, and diaphragm 76 is stationary.

If the vapor pressure below diaphragm 76 decreases, the force of spring 74 pushes the diaphragm downward. This pushes pin 80 and ball 82 downward, further opening aperture 90. This increases the amount of vapor flowing into chamber 86, increasing the pressure therein, and this pressure increases until the pressure in chamber 86 is brought back to the constant, equilibrium level. Conversely, if the vapor pressure within chamber 86 increases, this vapor pressure pushes diaphragm 76 upward. The diaphragm pulls pin 80 and ball 82 upward, restricting the vapor flow through inlet opening 90. This decreases the amount of vapor entering chamber 86, decreasing the pressure therein, and this pressure decreases until the pressure in chamber 86 is brought back to the constant, equilibrium level.

In operation, let us first assume that a maximum load condition exists on the refrigeration unit to require operation of all cylinders of the compressor to maintain the desired refrigeration capabilities of the unit. If the load on refrigeration unit 10 should diminish, the pressure of the refrigerant flowing through conduit 28 into manifold 34 will decrease. In essence, the suction pressure of the refrigerant gas flowing into manifold 34 varies directly with the load on the refrigeration unit; as the load decreases so will the pressure of refrigerant passing into manifold 34. The reduced pressure in manifold 34 will cause a concurrent reduction in the total force acting on the bottom surface of piston 52. As the pressure in chamber 49 is maintained at a constant level, the force acting on the top surface of piston 52 also remains at a constant magnitude. Thus, the force imbalance thus created results in piston 52 moving from the position shown in FIG. 2 (whereat a maximum flow of refrigerant passes to cylinder 30) downwardly within bore 41 towards manifold 34. The movement of piston 52 relative to port 58 resulting from a reduction in the refrigeration load tends to decrease the quantity of refrigerant passing from manifold 34 into suction chamber 35. In effect, piston 52 modulates the flow of refrigerant moving into header 35 in accordance with the changes in load on the refrigeration unit by changing the active flow area of port 58. As the load continues to decrease, thus reducing the force acting on the lower surface of piston 52, the piston will move within bore 41 to further reduce the active area of port 58 to further reduce the flow of refrigerant passing therethrough. Eventually, upon further decreases in the refrigeration load, piston 52 will move with respect to port 58 to completely terminate the flow of refrigerant therethrough. When this occurs, cylinder 30 is completely unloaded. The power input to the compressor is reduced generally in proportion to the movement of piston 52 with respect to port 58; as the piston reduces the flow of refrigerant through port 58 to cylinder 30, the power input to the compressor will likewise decrease since the compressor will require less energy to compress the refrigerant still flowing to its cylinders.

If the refrigeration load increases, the pressure of the refrigerant gas passing into manifold 34 increases to increase the force acting on the lower surface of piston 52 to thereby raise the piston within bore 41 to permit renewed flow of refrigerant gas through port 58. The quantity of refrigerant gas passing through the port will vary directly with the pressure of the refrigerant gas acting on the lower surface of piston 52. Thus, as the load continues to increase, the pressure acting on the lower surface of piston 52 will also increase to further move piston 52 with respect to port 58 to increase the flow passage opening defined thereby to permit a greater quantity of refrigerant gas to pass into suction header 35.

As may be readily recognized, the capacity control device of the present invention modulates the gas flowing to a bank of cylinders to improve the performance of the refrigeration unit by reducing the power consumption requirements of the unit at part-load conditions. The specific embodiment herein disclosed achieves the desired capacity control by regulating the movement of the capacity control device in response to changes in the difference in the pressure between suction pressure and a predetermined pressure operating in a chamber provided above a piston of the capacity control device. While the capacity control device has been illustrated as employed with a compressor used in an air conditioning system, the invention may also readily be employed with refrigeration units employed to chill water. Generally in such units, the temperature of the water leaving the evaporator is monitored to sense changes of the refrigeration load on the unit.

While a preferred embodiment of the present invention has been described and illustrated, the present invention may be otherwise embodied within the scope of the following claims.

What is claimed is:

1. Capacity control apparatus for a multi-cylinder refrigerant compressor employed in a mechanical refrigeration unit comprising:

means defining a manifold for delivering refrigerant vapor to less than all of the cylinders of the compressor;

a housing disposed between the manifold and the cylinders receiving refrigerant vapor therefrom for conducting refrigerant vapor from the manifold to these cylinders;

a piston reciprocally disposed within the housing for modulating movement between open and closed positions to modulate the flow of refrigerant vapor from the manifold to the cylinders receiving vapor therefrom, the piston dividing the housing into an upper chamber spaced from the manifold, and a lower chamber in communication therewith and located between the manifold and the upper chamber;

means for producing a relatively constant force in the upper chamber urging the piston to the closed position; and means for producing a variable force in the lower chamber urging the piston to the open position, the variable force producing means including vapor entering the housing from the manifold wherein the position of the piston and the quantity of refrigerant passing through the housing modulate in response to changes in the pressure of refrigerant vapor in the manifold.

2. A capacity control apparatus as defined by claim 1 wherein:

a lower portion of the housing defines a fluid inlet in communication with the manifold and a side of the housing defines a fluid outlet in communication with the cylinders receiving vapor from the manifold;

the piston defines generally opposed top and bottom surfaces with a side surface extending therebetween;

movement of the piston between the open and closed positions slides the side surface of the piston past the fluid outlet to vary the active flow area thereof;

the relatively constant force produced in the upper chamber acts against the top surface of the piston; and the variable force produced in the lower chamber acts against the bottom surface of the piston.

3. Capacity control apparatus as defined by claim 2 wherein the constant force producing means includes:

conduit means for conducting refrigerant discharged from the compressor into the upper chamber of the housing; and a constant pressure valve located in the conduit means and controlling the pressure of the vapor flowing therethrough to maintain the pressure in the upper chamber at a predetermined magnitude.

4. Capacity control apparatus as defined by claims 2 or 3 wherein the variable force producing means further includes:

retainer means located within the housing below the piston and secured to the lower portion of the housing; and spring means mounted on the retainer means, extending therefrom to the piston, and urging the piston upward away from the retainer means.

5. Capacity control apparatus as defined by claim 4 further including sealing means mounted on the piston and extending between the side surface thereof and the side of the housing to retard fluid flow between the upper and lower chambers of the housing.

* * * * *